United States Patent [19]

Buxmann

[11] Patent Number: 4,589,472

[45] Date of Patent: May 20, 1986

[54] PROCESS FOR PREVENTING METAL PENETRATING BETWEEN A MOLD WALL AND A NOZZLE

[75] Inventor: Kurt Buxmann, Sierre, Switzerland

[73] Assignee: Swiss Aluminium Ltd., Chippis, Switzerland

[21] Appl. No.: 613,632

[22] Filed: May 24, 1984

[30] Foreign Application Priority Data

Jun. 1, 1983 [CH] Switzerland ..... 3009/83

[51] Int. Cl.[4] ..... B22D 11/06; B22D 11/07

[52] U.S. Cl. ..... 164/472; 164/481

[58] Field of Search ..... 164/472, 481, 490

[56] References Cited

FOREIGN PATENT DOCUMENTS

| | | | |
|---|---|---|---|
| 57-17349 | 1/1982 | Japan | 164/481 |
| 57-17350 | 1/1982 | Japan | 164/481 |
| 57-25260 | 2/1982 | Japan | 164/437 |

*Primary Examiner*—Nicholas P. Godici
*Assistant Examiner*—J. Reed Batten, Jr.
*Attorney, Agent, or Firm*—Bachman & LaPointe

[57] ABSTRACT

In a caterpillar track type mold having opposed moving mold belts wherein molten metal is fed to the mold by a nozzle, a process for preventing back flow of metal between the moving mold belts and the nozzle comprising feeding a fluxing powder between the nozzle and the moving mold belts wherein the fluxing powder forms a protective skin on the surface of the molten metal downstream of the nozzle.

3 Claims, 1 Drawing Figure

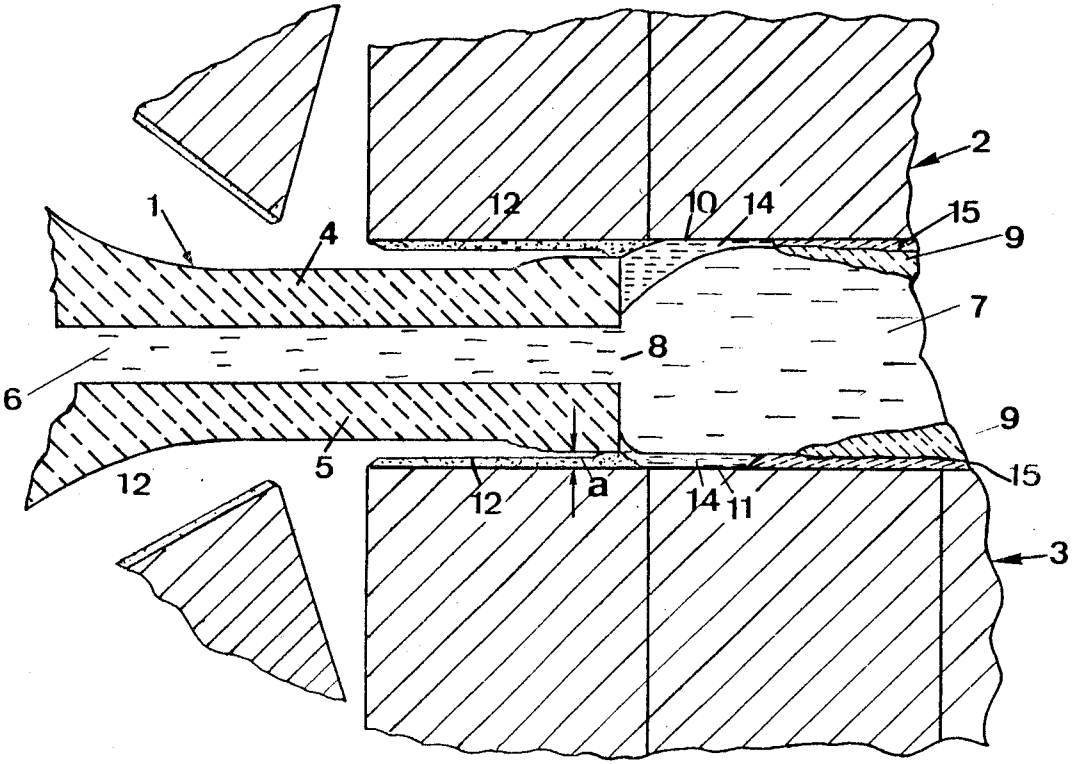
1
2
3
4
5
6
7
8
9
9
10
11
12
12
12
14
14
15
15
a

PROCESS FOR PREVENTING METAL PENETRATING BETWEEN A MOLD WALL AND A NOZZLE

BACKGROUND OF THE INVENTION

The present invention relates to a process for preventing back flow of metal between the moving mold belts of a caterpillar type track mold and the nozzle for feeding molten metal to the mold.

One of the most difficult problems in continuous casting, in particular casting ferrous and non-ferrous metals, arises from the design of the feeder nozzle by means of which the molten metal is introduced into the mold between the moving mold belts of a caterpillar track type mold. In the case of a caterpillar track type casting machine thin strip, that is, 20 mm thick is cast. Accordingly the nozzle must be of relatively small dimension especially in the region of the nozzle's mouthpiece.

One damage risk factor associated with the nozzle is the very high temperature of the metal flowing through it. There are only a few materials which are able to resist erosion or dissolution in the metal. Graphite is one of the few materials which can meet the requirements. Graphite, however suffers from the disadvantage that it is highly thermal conductive, with the result that the metal has a tendency to solidify in the nozzle.

Another suitable refractory material used widely in casting aluminum is a mixture of 30% diatomaceous earth (almost pure silica in the form of microscopic cells), 30% asbestos fibers, 20% sodium silicate (dry mixture) and 20% chalk (to form calcium silicate). Steel on the other hand is usually cast by employing a nozzle of pure $ZrO_2$ or $ZrSiO_4$.

The nozzle must not only be able to resist the thermal stresses due to the high temperature of the metal being cast, but also must withstand the resultant chemical attack and mechanical effects arising from fluctuating movement of the belts and bending of the nozzle due to the relatively large weight of the melt flowing through it. The bending or sagging of the nozzle leads to frictional rubbing of the nozzle on the belts and with that destruction of the nozzle itself.

Another problem encountered is back flow of metal, that is, molten metal from the nozzle flowing backwards over it. The molten metal emerging from the nozzle forms, in the region between the nozzle outlet and the point of first contact with the upper moving mold belt, a radius of curvature which depends essentially on the surface tension of the metal, the metallostatic pressure at which the metal leaves the nozzle, and the speed of the moving mold belts. Due to premature solidification of the metal a build up of metal can occur which causes the metal to flow back behind the tip of the nozzle. This back flow is very undesirable as it interrupts the continuous casting process very markedly and hinders proper coordination of the nozzle and the casting machine.

A known method for avoiding the above mentioned problems is revealed in the Swiss patent application No. 3019/83 wherein an air cushion is formed in a space between the nozzle and the moving mold belts. By means of the air cushion a radius of curvature on the molten metal between the outlet of the nozzle and the point of contact of the melt with the upper mold belt is influenced. The foregoing method is very effective but requires a particular design of nozzle body and exact knowledge of the force of the air stream to be supplied and the amount of pressure in the air cushion formed.

Accordingly, it is the principal object of the present invention to develop a process to prevent the back flow of metal at the nozzle.

SUMMARY OF THE INVENTION

The foregoing object is achieved by way of the present invention wherein a fluxing powder is introduced between the nozzle and the moving mold belts of a caterpillar track mold such that the fluxing powder forms a protective skin or layer on the melt surface downstream of the nozzle.

By way of the foregoing the space between the nozzle and the moving mold belts which could be penetrated by the melt is filled by another material so that the melt does not have the possibility of penetrating this space.

The powder, which is available commercially, has a melting point that is just below that of the metal to be cast. If the powder runs over the edge above the outlet of the nozzle and into the molten metal then this powder likewise liquefies on contact with the melt and forms a protective skin on it. This protective skin also prevents a build up of melt, that is, flow back over the nozzle, but also protects the melt surface from oxidation.

Shortly after the melt has left the nozzle and has made first contact with the cooled mold, it starts to solidify. However, as it drags the liquefied powder with it, it does not immediately come into contact with the mold belt. Therefore, the liquid from the powder solidifies first and forms a very effective layer of lubricant between the mold belts and the subsequently solidifying metal crust.

Introduction of the powder between the nozzle and the moving mold belts can be brought about for example via a blower behind or on the nozzle. Manual or mechanical introduction of the powder also lies within the scope of the invention.

It is preferred however for the powder to be adhesively deposited on the work face of the mold belts before it reaches the space between the nozzle and the mold belts. Such a process is described in the German patent publication No. DE-OS 31 20 582 and is suitable for deposition purposes. Within the scope of the invention however are other processes by means of which a surface can be readily coated with a powder.

The amount of powder or thickness of layer to be deposited on the work face of the mold is selected essentially in accordance with the distance between the nozzle and the mold belts. It must in each case be chosen such that the distance is completely filled in order that back flow of metal at the nozzle is effectively prevented.

BRIEF DESCRIPTION OF THE DRAWING

The drawing is a schematic showing part of a nozzle and the moving belts of a continuous casting machine.

DETAILED DESCRIPTION

A nozzle 1 for feeding molten metal between two moving belts 2 and 3 of a caterpillar track type mold is delimited by an upper nozzle wall 4 and a lower nozzle wall 5 between which is a channel 6 for feeding molten metal 7. This molten metal 7 emerges from an outlet 8 in the nozzle 1 and shortly after the nozzle 1 begins to solidify to solid metal 9 from the outside as a result of the cooling action of the mold belts 2, 3.

During the operation of the caterpillar track type mold, a commercially available fluxing powder 12 is applied adhesively to the facing mold work faces 10 and 11. The thickness of the layer of powder 12 does not correspond exactly with the distance a between nozzle wall 4 or 5 and mold work face 10 or 11.

The melting point of the powder 12 should lie just slightly below that of the metal 7 to be cast. If the powder 12 comes into contact with the melt 7 after the nozzle 1, then the powder 12 also becomes liquid and forms a protective skin 14 on the melt 7 which prevents the melt 7 from flowing back over the nozzle 1. At the start more powder is introduced so that an adequate protective skin 14 can form, in particular in the region after the outlet 8.

The cooled work faces 10, 11 of the mold not only cause the melt 7 to solidify but also to make the protective skin 14 start solidifying into a layer 15 only a short distance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for preventing back flow of metal to a space between moving mold belts of a continuous casting mold and a nozzle for feeding molten metal to the mold formed by said moving mold belts comprising introducing a fluxing powder between the nozzle and the moving mold belts wherein the fluxing powder forms a protective skin on the surface of the molten metal downstream of the nozzle, said fluxing powder having a melting point which lies just below that of the metal being cast so that the protective skin formed by the fluxing powder becomes liquid on contact with the molten metal and solidifies in the region where the molten metal solidifies.

2. A process according to claim 1 wherein the fluxing powder is applied to the moving mold belts.

3. A process according to claim 1 wherein the fluxing powder is applied to the moving mold belts in an amount which does not completely fill the space between the nozzle and the moving mold belts.

* * * * *